US011253056B2

(12) United States Patent
Togni

(10) Patent No.: US 11,253,056 B2
(45) Date of Patent: Feb. 22, 2022

(54) EXTENSION TABLE

(71) Applicant: B 4 LIVING SPA, Camerano (IT)

(72) Inventor: Giacomo Togni, Agugliano (IT)

( * ) Notice: Subject to any disclaimer, the term of this patent is extended or adjusted under 35 U.S.C. 154(b) by 0 days.

(21) Appl. No.: 17/158,847

(22) Filed: Jan. 26, 2021

(65) Prior Publication Data

US 2021/0227968 A1 Jul. 29, 2021

(30) Foreign Application Priority Data

Jan. 28, 2020 (IT) ..... 102020000001621

(51) Int. Cl.
*A47B 1/04* (2006.01)
*A47B 1/08* (2006.01)
*A47B 1/10* (2006.01)

(52) U.S. Cl.
CPC ..... *A47B 1/04* (2013.01); *A47B 1/08* (2013.01); *A47B 1/10* (2013.01)

(58) Field of Classification Search
CPC .... A47B 1/04; A47B 1/08; A47B 1/10; A47B 2001/053; A47B 2001/085; A47B 17/03; A47B 17/036; A47B 17/065
See application file for complete search history.

(56) References Cited

U.S. PATENT DOCUMENTS 2,614,013 A * 10/1952 Langius ..... A47B 1/08 108/69
3,033,629 A * 5/1962 Riendeau ..... A47B 1/08 108/85
4,815,393 A * 3/1989 Pollak ..... A47B 1/04 108/65
10,568,414 B1 * 2/2020 Glattstein ..... A47B 46/00
2011/0247529 A1 * 10/2011 Morbidelli ..... A47B 1/05 108/50.11
2017/0367475 A1 * 12/2017 Carrera Gonzalez ..... A47B 17/065
2018/0344023 A1 * 12/2018 Andersson ..... A47B 1/10
2020/0093256 A1 * 3/2020 Mansson ..... A47B 41/02

OTHER PUBLICATIONS

International Search Report and Written Opinion of the International Searching Authority for corresponding PCT/TR2020/050503, dated Oct. 21, 2020.
https://www.designboom.com/architecture/dror-gensler-galataport-masterplan-istanbul-turkey-05-04-2017/(Cited in International Search Report).
https:luxurylaunches.com/other_stuff/dror-and-gensler-propose-worlds-first-underground-cruise-operation-for-istanbuls-galataport.php (Cited in International Search Report).

* cited by examiner

*Primary Examiner* — Matthew W Ing
(74) *Attorney, Agent, or Firm* — Egbert, McDaniel & Swartz, PLLC

(57) ABSTRACT

An extension table having a fixed frame and a mobile frame, and a safety device that includes mechanisms that prevent the extension top from rotating if the table is not previously extended to the maximum extension length. The safety device has a revolving disk fixed under the extension top and having a shaped slot where a vertical pin is slidingly coupled, the vertical pin protruding from a longitudinal rod supported by the mobile frame.

10 Claims, 14 Drawing Sheets

SECT. X - X

SECT. X1 - X1

EXTENSION TABLE

BACKGROUND OF THE INVENTION

1. Field of the Invention

The present invention relates to an extension table. Particularly, the extension table according to the invention belongs to the type of tables that comprise a fixed frame and a mobile frame that is telescopically coupled with said fixed frame, in such a way that the table can be disposed in two end-of-travel positions, namely a minimum length position and a maximum length position.

2. Description of Related Art Including Information Disclosed Under 37 CFR 1.97 and 37 CFR 1.98

The fixed frame of an extension table comprises a horizontal structure with rectangular and square shape, formed of a parallel pair of longitudinal side-members connected by a crosspiece wherein a first pair of legs is fixed. The mobile frame has a similar structure, which comprises a horizontal structure with rectangular and square shape, formed of a parallel pair of longitudinal side members connected by a first crosspiece wherein a second pair of legs is fixed.

The two longitudinal side members of the fixed frame are telescopically coupled with the two side members of the mobile frame. The horizontal structure of the mobile frame acts as support for an extension top supported by an extension-holding trolley supported in turn by the two side members of the mobile frame. The extension top is fixed on the support trolley with possibility of revolving around a vertical axis, in such a way to be disposed in two end-of-travel positions staggered by an angle of 90°.

When the table is in the minimum length position, said extension-holding trolley is positioned under the main top, together with the extension top associated with it.

In order to place the extension top in adjacent position relative to the main top, the following sequence of operations must be performed:

a) to make the mobile frame slide away from the fixed frame, in such a way to give the table its maximum length;
b) to make the extension-holding trolley slide away from the fixed frame, in such a way that the extension top is no longer surmounted by the main top; it must be noted that, because of a cam and tappet coupling between said trolley and the two side members of the mobile frame, the extension top goes from a position wherein it is disposed under the main top to a position wherein it is coplanar to the main top;
c) to rotate the extension top by 90° with respect to the extension-holding trolley;
d) to make the mobile frame slide towards the fixed frame until the transverse side of the extension top is in contact with the transverse side of the main top.

The major drawback that impairs said type of extension tables consists in the fact that, if no attention is paid during the first extension step of the table to reach said maximum length value, a collision may occur during the rotation step of the extension top between a corner of the extension top and the transverse side of the main top.

In order to avoid such a risk of collision, said extension tables are often provided with safety devices that comprise mechanisms able to prevent the extension top from rotating if the table is not previously extended to its maximum extension position.

DE102012219036 discloses an extension desk comprising a tilting mechanism for tilting the faceplate with a predetermined tilt angle to a storage position. The two frame portions are pulled-out parallel to a transverse axis of a main plate. A support roller is provided for supporting the faceplate in an application position. A rotational coupling element is provided for rotatably coupling the faceplate to the frame portions in an extended position, for rotating the faceplate perpendicular to a pivot axis of the main plate.

WO2017211479 discloses a piece of furniture having a table top, a pull-out mechanism and has an extension panel which can be transferred from a stowage position, in which it is stowed beneath the table top when the pull-out mechanism has not been pulled out, into a working position, in which it adjoins the table top in a flush manner when the pull-out mechanism has been pulled out.

BRIEF SUMMARY OF THE INVENTION

The purpose of the present invention is to disclose an extensible table of the type that is previously described, which is provided with an anti-collision safety device that is conceptually and functionally different from the ones of the prior art, is more reliable and easier to make or repair.

This purpose is achieved according to the present invention with the characteristics of the first independent claim.

Advantageous embodiments of the invention appear from the dependent claims.

BRIEF DESCRIPTION OF THE SEVERAL VIEWS OF THE DRAWINGS

For the sake of clarity, the description of the extension table according to the invention continues with reference to the attached drawings, which have a merely illustrative, not limiting value, wherein.

DETAILED DESCRIPTION OF THE INVENTION

The extension table (100) has the typical configuration and operation mode of the prior art with reference to the telescopic structure, the frame and the pull-out maneuver of the extension top.

The extension table (100) comprises a fixed frame (10) and a mobile frame (20) telescopically coupled with the fixed frame (10), in such a way that the table (100) can be in two end-of-travel positions:

- a first contracted position (see FIG. 3), which corresponds to a minimum length (L1), and
- a second extended position (see FIG. 5), which corresponds to a maximum length (L2).

Figure 4:
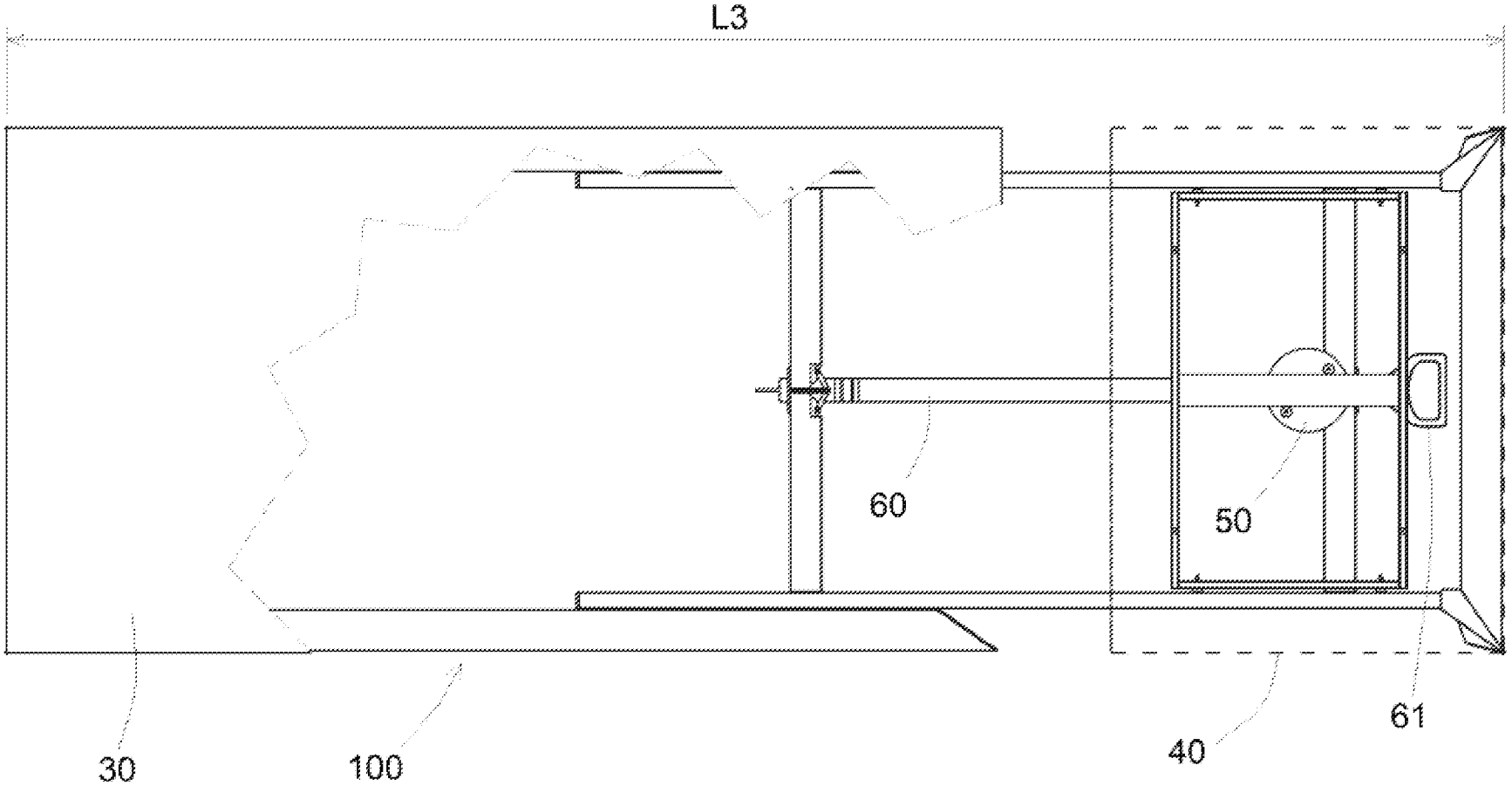
FIG. 4 is a top view of the extension table according to the invention, in extended position, but not in maximum extension position; in this figure, the main top is partially omitted to show the parts that are disposed under the main top, and the extension top is shown with a broken line.

The table can be disposed in intermediate positions at the two aforesaid end-of-travel positions, which correspond to intermediate lengths (L3) comprised between the values (L1 and L2), as shown in FIG. 4.

The fixed frame (100) comprises a horizontal rectangular structure formed of a parallel pair of longitudinal side members (21) connected by a crosspiece (22). The horizontal rectangular structure comprises a pair of legs (13), preferably associated with the (12).

The mobile frame (20) comprises a horizontal rectangular structure formed of a parallel pair of longitudinal side members (21) connected by a first crosspiece (22). The horizontal structure of the mobile frame also comprises a pair of legs (23), preferably associated with the crosspiece (22). The parallel pair of longitudinal side members (21) is also connected by a second crosspiece (24) and by a third reinforcing crosspiece (25), respectively disposed in proximal and distal position relative to said first crosspiece (22).

Figure 1:
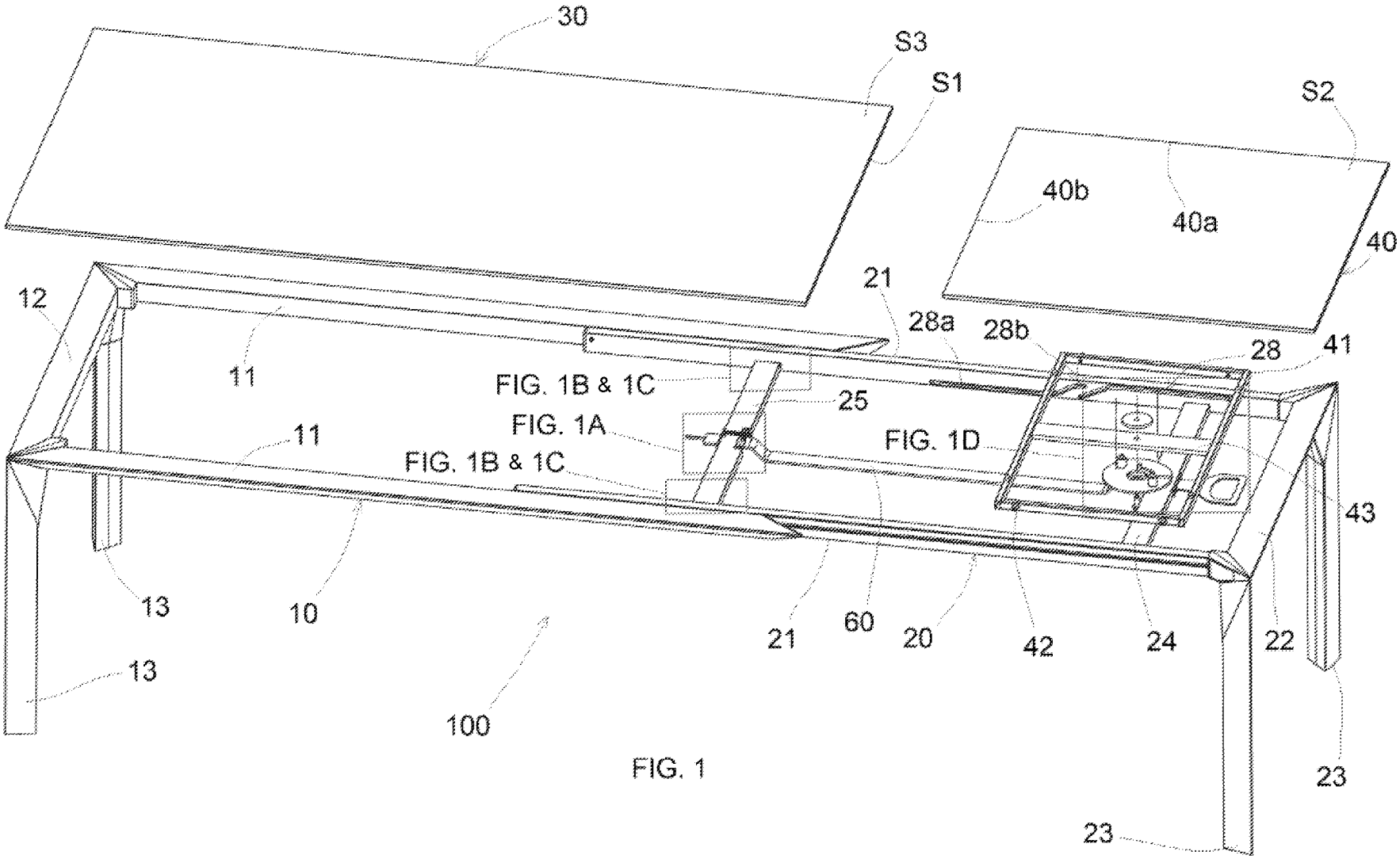
FIG. 1 is an axonometric view of the extension table according to the invention in its maximum extension position; in this figure, the main top and the extension top are raised from the table in such a way to show the constructive elements disposed under the main top and the extension top.
Figure 1B:
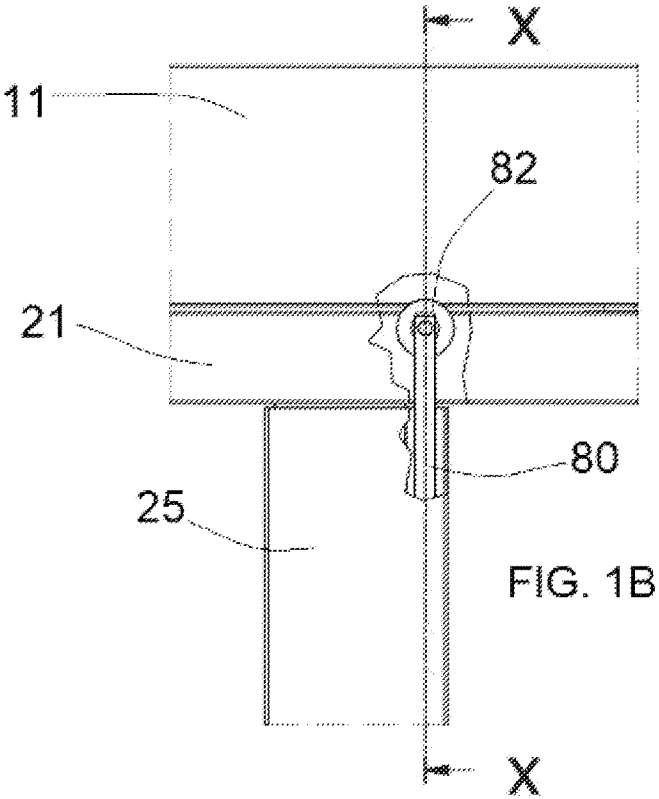
FIGS. 1A,1B, 1C and 1D are enlarged views of construction details shown in FIG. 1.
Figure 1E:
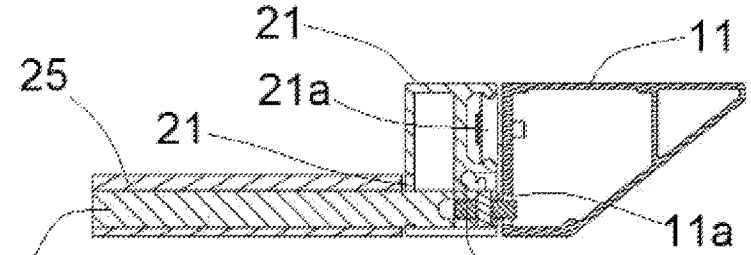
FIG. 1E is a sectional view taken along the plane X of FIG. 1B.
Figure 2:
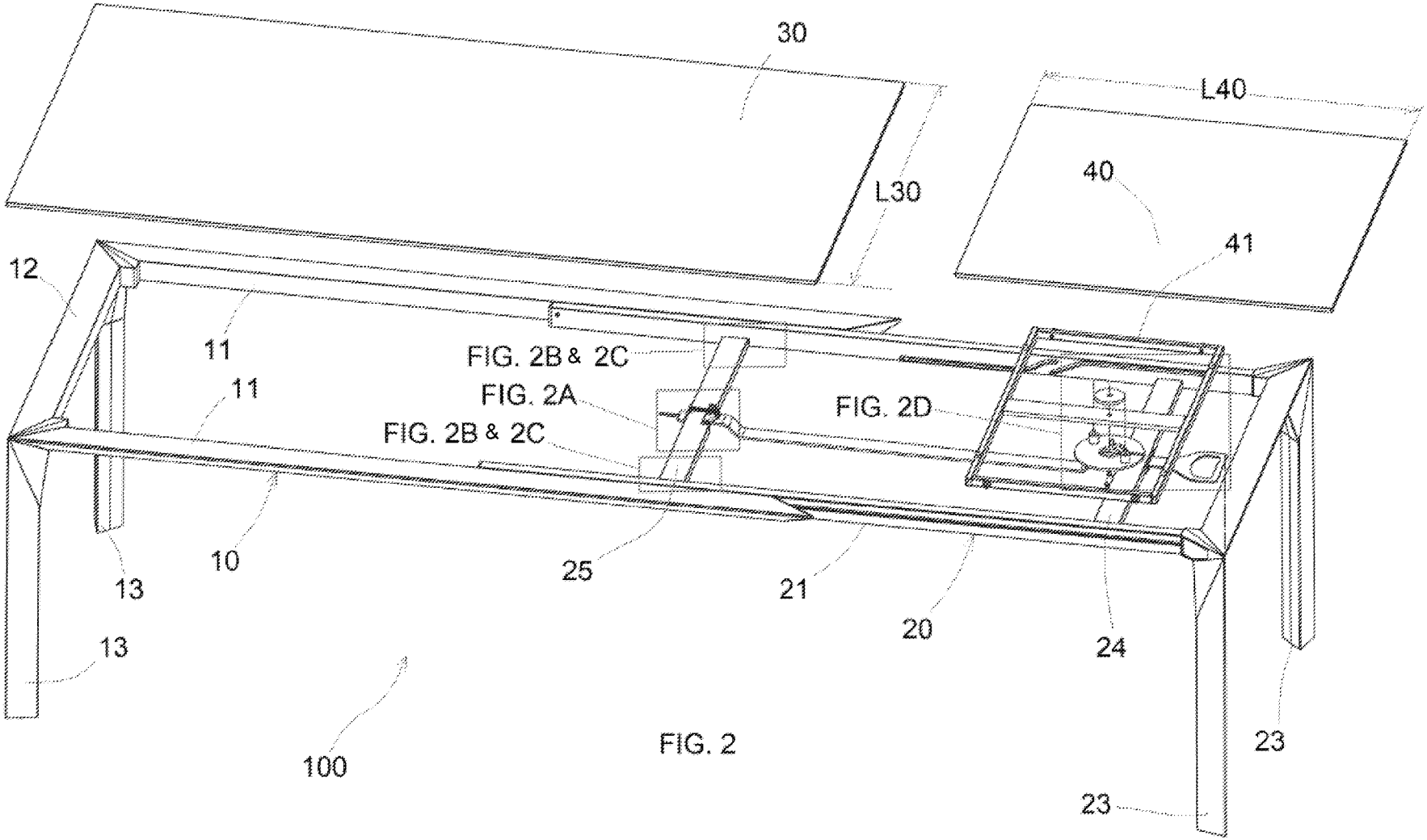
FIG. 2 is an axonometric view of the extension table according to the invention in extended position, but not in maximum extension position; in this figure, the main top and the extension top are raised from the table in such a way to show the constructive elements disposed under the main top and the extension top.
Figure 2B:
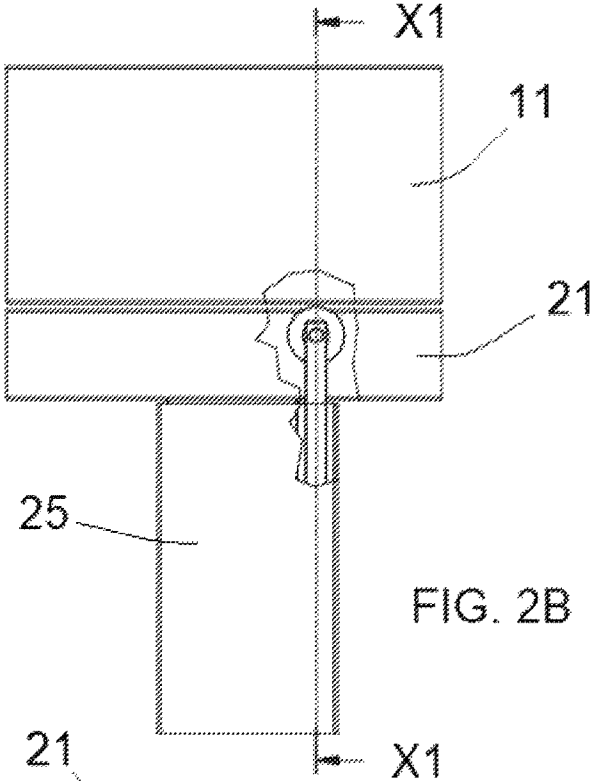
FIGS. 2A, 2B, 2C and 2D are enlarged views of construction details shown in FIG. 2.
Figure 2E:
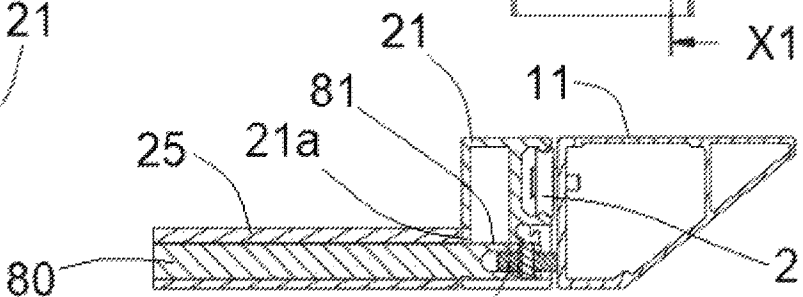
FIG. 2E is a sectional view with the plane X1 of FIG. 2B.
Figure 3:
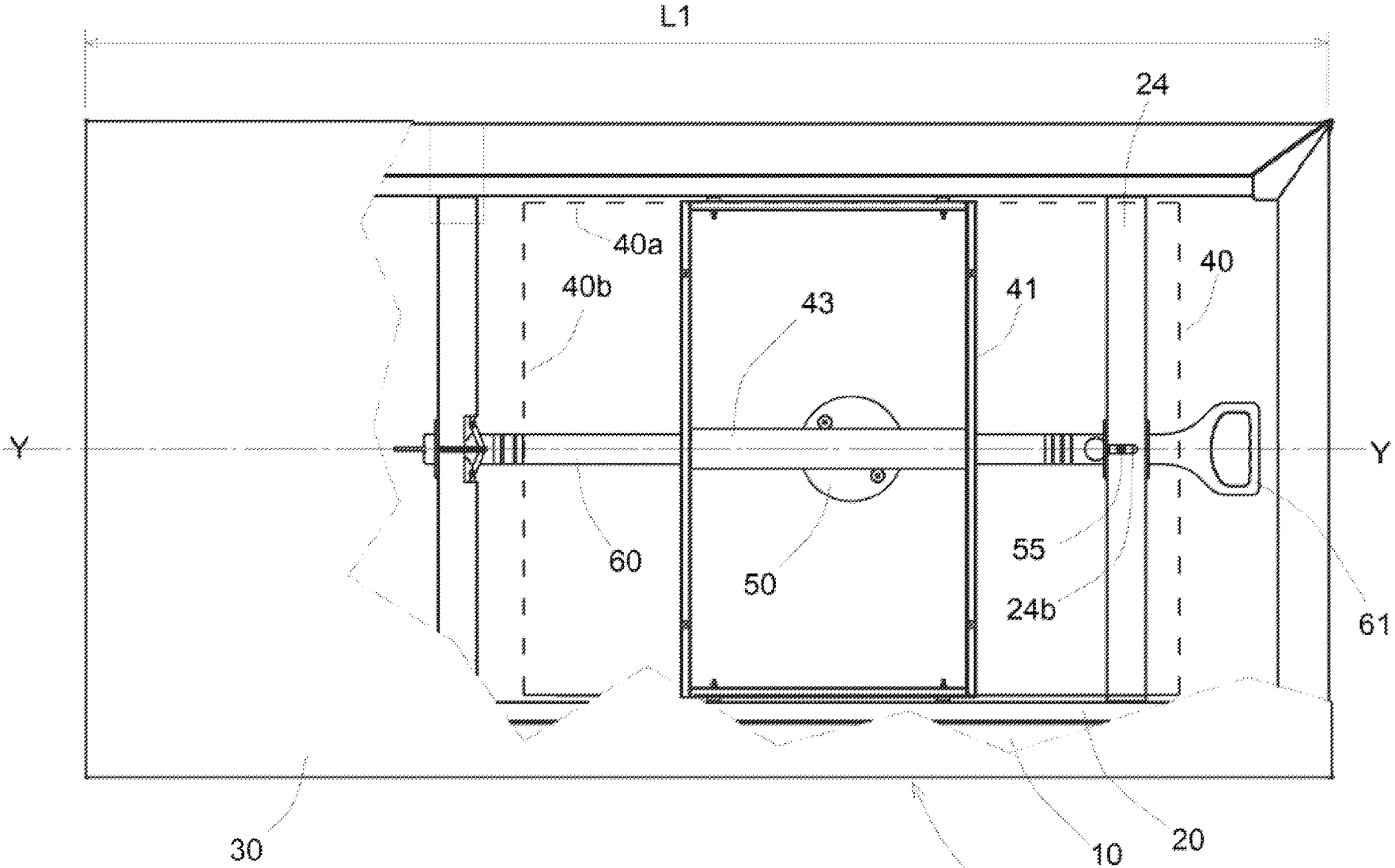
FIG. 3 is a top view of the extension table according to the invention, in maximum contracted position, which corresponds to the minimum length of the table, with the extension top that is concealed under the main top; in this figure, the main top is partially omitted to show the parts that are disposed under the main top, and the extension top is shown with a broken line.

The longitudinal side members (11) of the fixed frame (10) adjoin the longitudinal side members (21) of the mobile frame (20) whereto they are coupled by means of ordinary means with the possibility of sliding mutually, such as for example bearings (2), as shown in FIGS. 1E and 2E. The horizontal structure of the fixed frame (10) acts as support for a main top (30) that is the only top when the table (10) is in said contracted position with minimum length (L1), as shown in FIG. 3.

The main top (30) is fixed over the pair of longitudinal side members (11) and extends astride the two crosspieces (12, 22).

The horizontal structure of the mobile frame (20) acts as support for an extension top (40) supported by an extension-holding trolley (41) that is slidingly supported in turn by the two side members (21) of the mobile frame (20).

Figure 6:
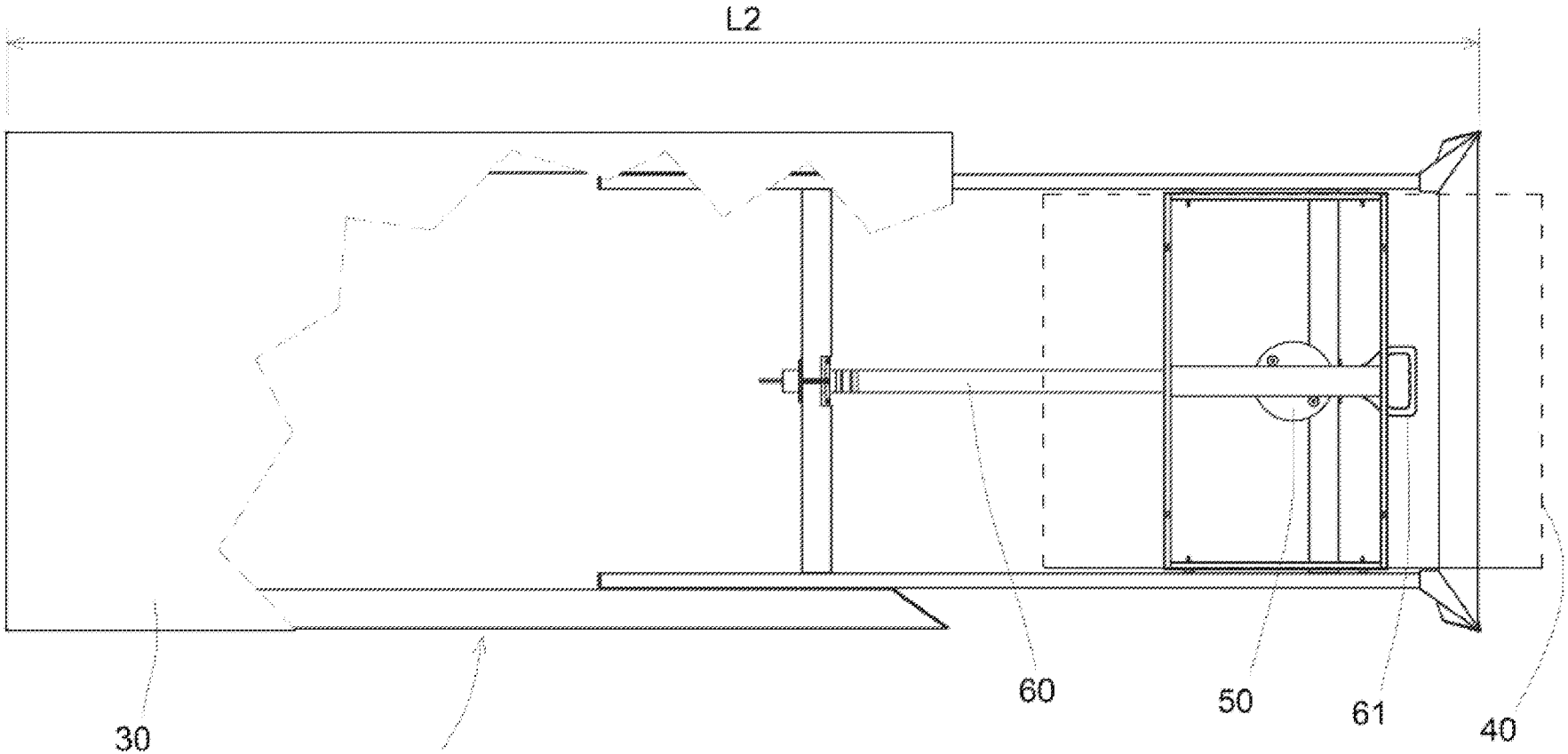
FIG. 6 is the same as FIG. 5, except in that the extension top is raised in such a way to be coplanar to the main top.
Figure 7:
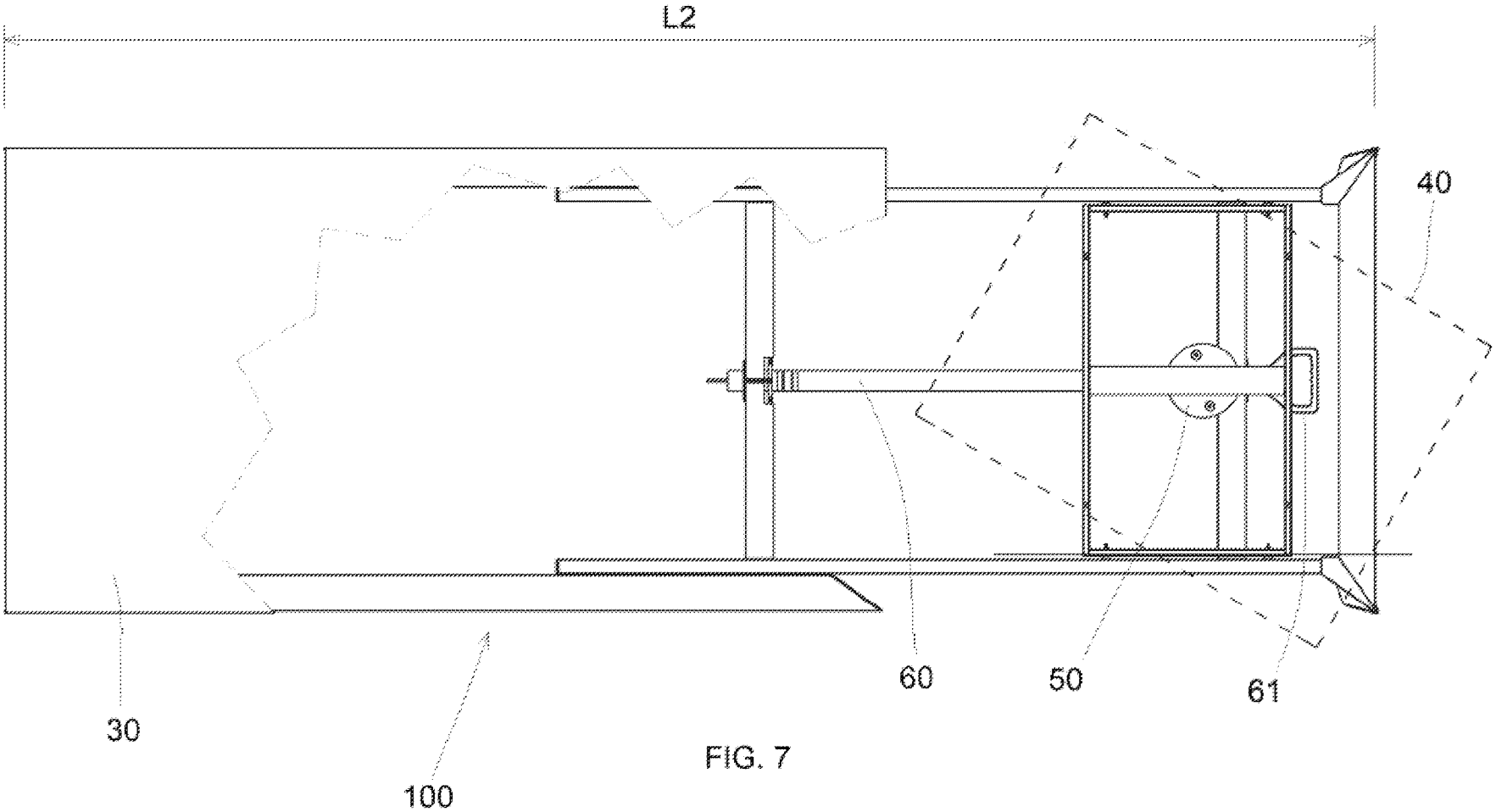
FIG. 7 is the same as FIG. 6, except in that the extension top is rotated by an angle lower than 90°, during the rotation.

In order to conceal the extension top (40) under the main top (30), while the table (100) is in its contracted position with minimum length (L1), the extension-holding trolley (41) and the extension top (40) can be disposed in two parking positions with respect to the pair of side members (21) of the mobile frame (20):

- a first lower parking height, wherein the upper surface (S2) of the extension top (40) lies under the lower surface (S1) of the main top (30), as shown in FIG. 3;
- a second parking height, in higher position, wherein the upper surface (S2) of the extension top (40) is coplanar with the upper surface (S3) of the main top (30), as shown in FIG. 6.

In order to move the extension-holding trolley (41) up and down, the extension-holding trolley (41) is coupled with the two side members (21) of the mobile frame (20) by means of cam-tappet means that impose up-down travels during the forward or backward translations with respect to the side members (21).

FIGS. 1 and 2 show said means of cam-tapper type, which provide for rails (28) obtained in the side members (21), where wheels (42) mounted on the extension-holding trolley (41) are slidingly inserted.

The extension-holding trolley (41) comprises a rectangular frame formed of a pair of longitudinal sides (41*a*) connected at 90° by a pair of crosspieces (41*b*).

The wheels (42) project out of the longitudinal sides (41*a*) and slide along the rails (28). The rails (28) comprise a long rectilinear section (28*a*) joined with an end section (28*b*) with inclined profile.

The extension-holding trolley (41) also comprises a flat strip (43) that extends between two central points of the pair of transverse sides (41*b*).

Figure 8:
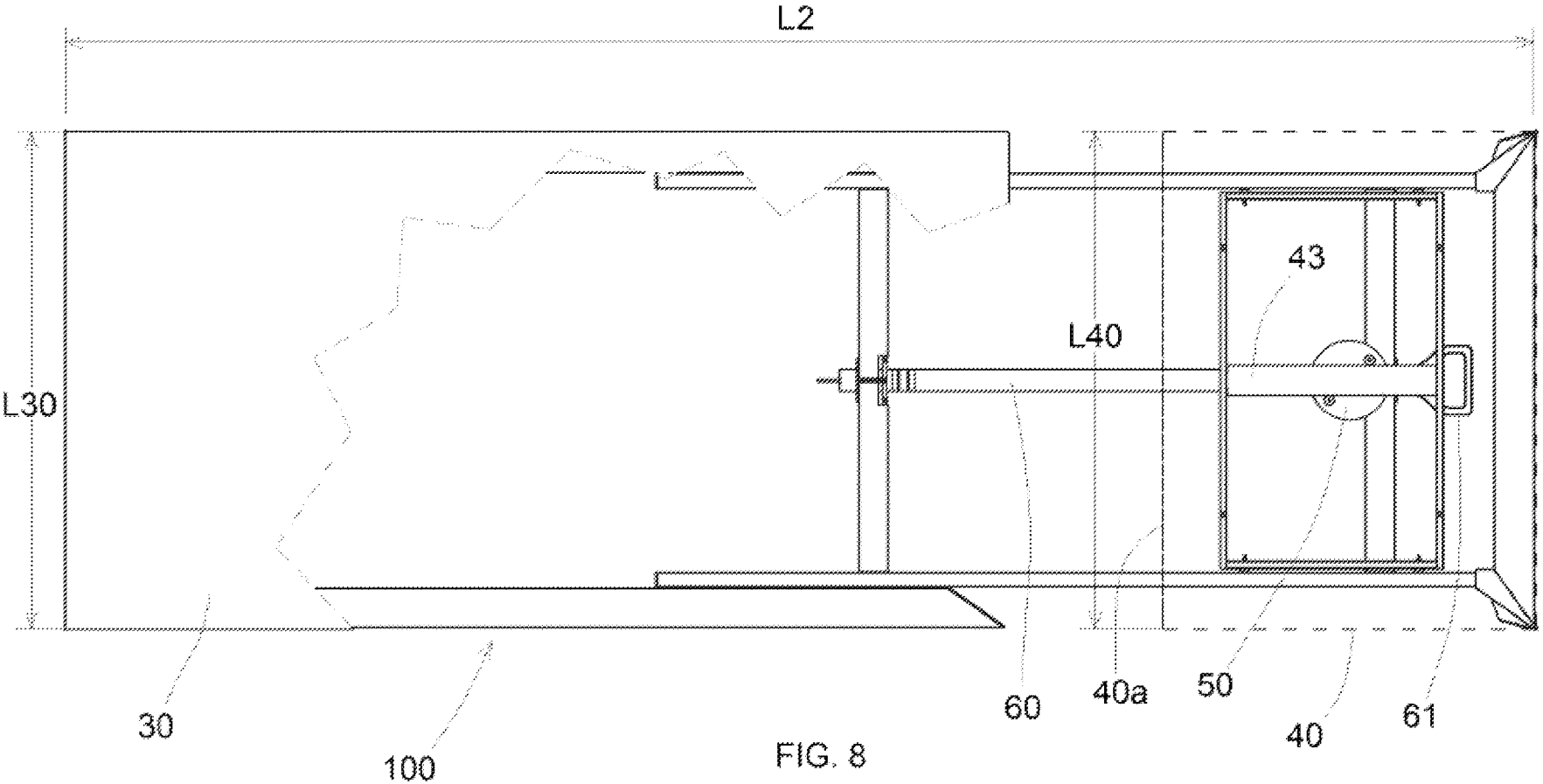
FIG. 8 is the same as FIG. 6, except in that the extension top is rotated by an angle of 90°, at the end of the rotational travel, but not in contact with the main top.

The extension top (40) has a rectangular shape and one side (40*a*) with width (L40) equal to the width (L30) of the main top (30), as shown in FIG. 8. In view of the above, the extension top (40) can be disposed in two different parking positions staggered by an angle of 90°:

- a first position, wherein the side (40*a*) is orthogonal to the longitudinal axis of the table (100) and interfaced to the main top (30), as shown in FIG. 8;
- a second position, wherein the side (40*a*) is parallel to the longitudinal axis of the table (100) and disposed under the main top (30), as shown in FIG. 3.

In view of the above, the extension table (40) must be free to rotate around a vertical axis (Z) that intersects the axis of longitudinal symmetry (Y) of the extension table (100).

The other side (40*b*) of the extension table (40) has a lower length than the width (L40), in such a way that the extension top (40) can be disposed between the pair of side members (21) of the mobile frame (20), as shown in FIG. 3.

The innovative peculiarity of the extension table (100) is represented by the safety mechanisms to enable a free rotation of the extension top (40), only in the condition wherein the mobile frame (20) has reached the end of the extraction travel relative to the fixed frame (10), preventing a free rotation of the extension top (40) in all the other conditions, namely until the length of the table has a lower value than the maximum value (L2) to avoid a risk of collision.

Figure 1A:
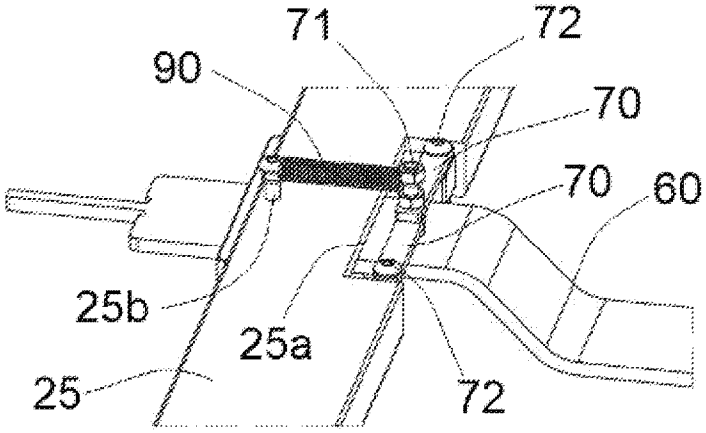
Figure 1C:
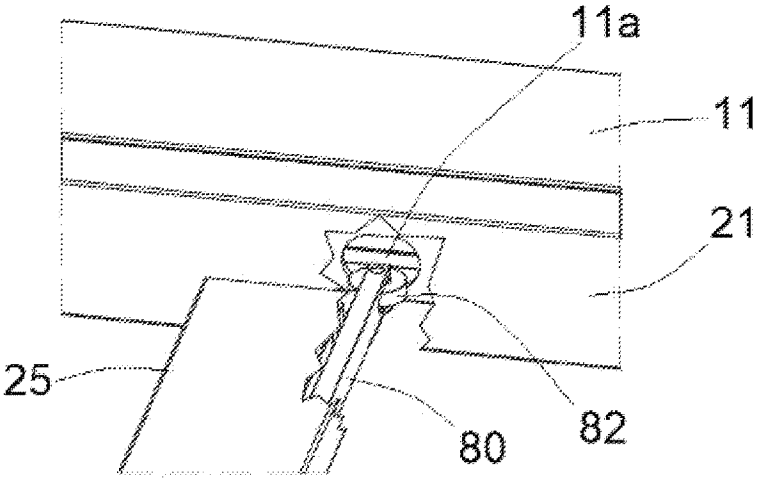
Figure 1D:
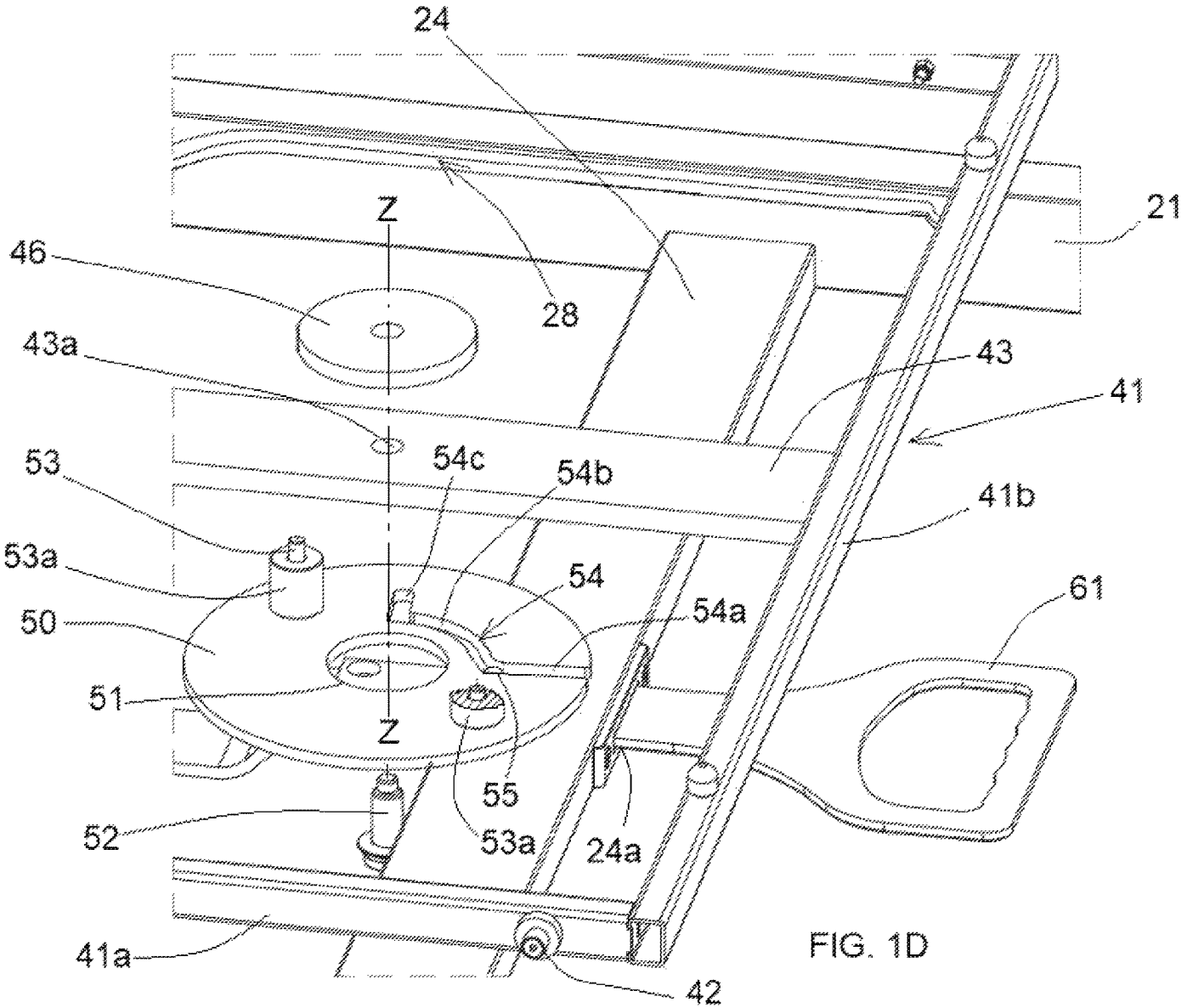
Figure 2A:
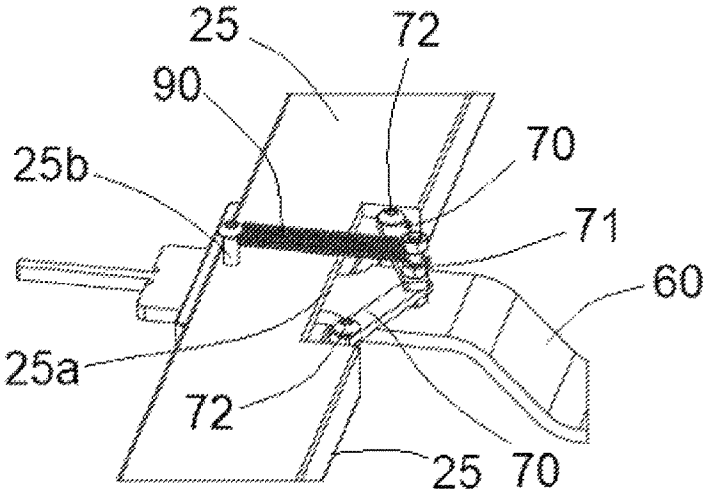
Figure 2C:
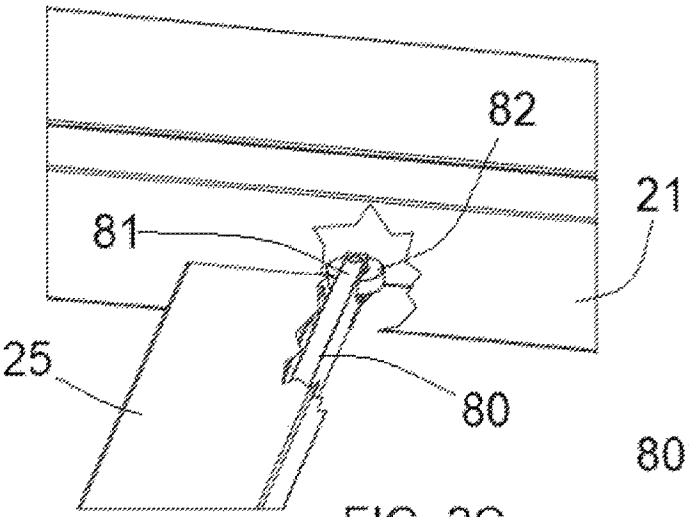
Figure 2D:
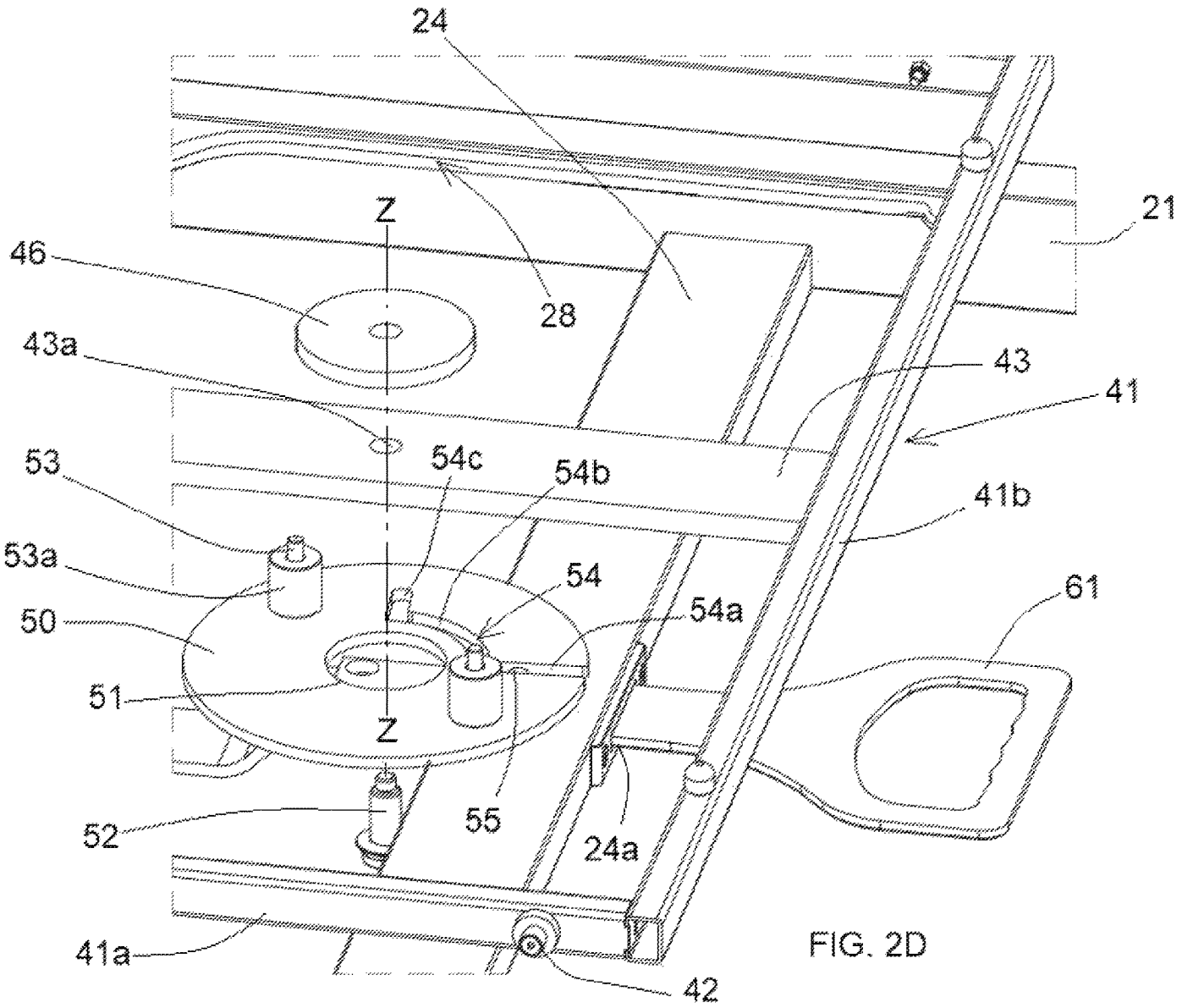

With reference to FIGS. 1D and 2D, a revolving disk (50) is provided under the flat strip (43), with the possibility of rotating freely, in both directions, with respect to a vertical axis (Z) passing through the center of the revolving disk (50) and of the extension top (40).

More precisely, the revolving disk (50) is centrally provided with a hole (51) crossed by a vertical screw (52) that is inserted from below through said hole (51) of the revolving disk and through a hole (43*a*) obtained on said flat strip (43) in order to be directly or indirectly screwed under the extension top (40). The hole (51) of the revolving disk is larger than the hole (43*a*) of the flat strip.

The screw (52) is used to connect the extension top (40) to the extension-holding trolley (41), without preventing its free rotation relative to a vertical axis (Z).

The reference numeral (46) indicates an anti-friction plate disposed between the extension top (40) and the flat strip (43). The plate (46) is suitable for favoring the rotation of the extension top (40).

The revolving disk (50) is fixed to the extension top (40) by means of a diametrically opposite pair of screws (53) that are inserted from below through said revolving disk (50) and through a pair of bushings (53*a*).

Every time the extension top (40) is driven by the user in rotation around the vertical axis (Z), also the revolving disk (50) suffers a simultaneous rotation in the same direction because of the connection provided by the screws (53), whereas the bushings (53*a*) act as stop for the alternate rotations of the extension top (40), when said bushings (53*a*) are stopped in the flat strip (43) disposed in intermediate position.

Said revolving disk (50) is provided with a shaped slot (54), comprising three sections:

- a first rectilinear section (54*a*) directed in radial direction from the perimeter edge of the revolving disk (50) towards the hole (51) of the revolving disk, without reaching said hole (51);
- a second curvilinear section (54*b*) joined with the first rectilinear section (54*a*) that extends for an arch equal to one fourth of circumference;
- a third rectilinear section (54*c*) joined with the second curvilinear section (54*b*) and directed in radial direction towards the perimeter edge of the revolving disk (50) without reaching it.

While the extension top (40) cannot rotate, the first rectilinear section (54*a*) of the shaped slot (54) is perfectly aligned with the longitudinal axis (Y) of the extension table (100).

As hereinafter explained in detail, the shaped slot (54) is suitable for being coupled with a vertical pin (55) that projects from a longitudinal rod (60), which is disposed immediately under the revolving disk (50) and is slidingly supported by the mobile frame (20). More precisely, the longitudinal rod (60) slidingly crosses the second and the third of the reinforcing crosspieces (24 and 25), which are provided with slots (24*a* e 25*a*).

Figure 5:
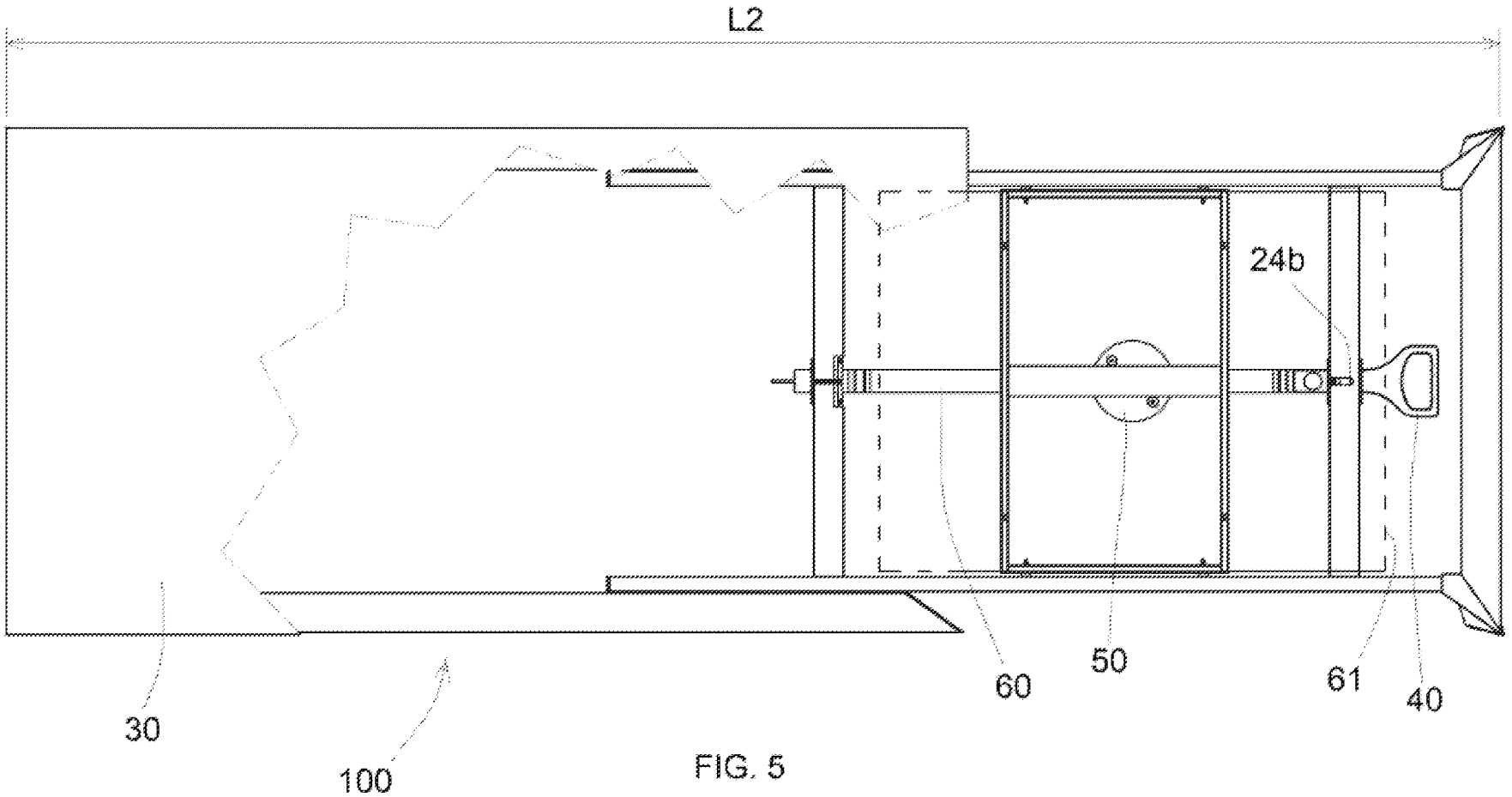
FIG. 5 is a top view of the extension table according to the invention, in maximum extension position; in this figure, the main top is partially omitted to show the parts that are disposed under the main top, and the extension top is shown with a broken line, disposed in a position at a lower height than the height of the main top.

As shown in FIGS. 3 and 5, the second reinforcing crosspiece (24) comprises a longitudinal notch (24*b*), in aligned position with said axis (Y), which houses and guides the travels of the pin (55) that projects above said crosspiece (24).

When the extension-holding trolley (41) slides to the end-of-travel position, along said rails (28), and away from the main top (30), as shown in FIG. 6, said pin (55) is inserted in said first rectilinear section (54*a*) of the shaped slot (54), said pin (55) being suitable for being in two different positions, according to the extension level of the table (100), as shown in FIG. 2D.

If the length of the extended table has lower length values (L3) than the length value (L2) of maximum extension, then the pin (55) is positioned along said first rectilinear section (54*a*), hindering the rotation of the extension top (40), whereas when the length of the extension table (100) has said maximum value (L2), said pin (55) is automatically moved forward to the end-of-travel position, being disposed in a position wherein it is disposed at the end of the first rectilinear section (54*a*) and on the opening of the second curvilinear section (54*b*), in a position wherein it is no longer able to hinder the rotation of the extension top (40), as shown in FIG. 1D.

The extension table (100) also comprises automatic means for moving the vertical pin (55) mounted on said mobile frame (20) and suitable for moving said vertical pin (55) to its second end-of-travel position, allowing the rotation of the revolving disk (50) only when the length of the extension table (100) is the maximum length (L2).

Said automatic means for moving the vertical pin (55) comprise a pre-loaded spring (90) and said longitudinal rod (60). The longitudinal rod (60) has a first end with a handle (61) near said crosspiece (22) of the mobile frame (20). The longitudinal rod (60) has a second end that supports a pair of compass levers (70) hinged in a pin (71) disposed in the vertex of the compass. The pin (71) is fixed to said longitudinal rod (60), whereas two pins (72) disposed at the feet of the legs of the compass are fixed to two sliding arms (80) oriented perpendicularly to the longitudinal axis (Y) of the table (100) and inserted through said third reinforcing crosspiece (25). The third reinforcing crosspiece (25) has a tubular structure to house and guide said pair of transverse arms (80) in opposite travels.

The pre-stretched spring (90) has a first end fixed to the pin (71) and a second end fixed to a hook (25*b*) fixed to the crosspiece (25), as shown in FIGS. 1A and 2A.

Said transverse arms (80) cross the third crosspiece (25) for its entire length, protruding from the third crosspiece with the ending section (81), wherein a wheel (82) that revolves in idle around a vertical axis is mounted.

As shown in FIGS. 1E and 2E, the side members (21) of the mobile frame (20) have a through slot (21*a*) suitably dimensioned to house said ending section (81) and the wheel (82), which is stopped against the side member (11) externally interfaced with the side member (21), as shown in FIG. 2E.

The wheels (82) constantly press the side members (11) of the fixed frame (10) because the pin (71) of the compass levers (70) is subject to the return action of said pre-stretched spring (90) that tends to diverge the two compass levers (70) until they are perfectly aligned one with the other and with the transverse arms (80), as shown in FIG. 1A.

Such a condition can only occur when the length of the table (100) has its maximum value (L2) because two niches (11*a*) are provided in a suitable position on the side members (11) of the fixed frame (10) for the click-in penetration of said wheels (82), as shown in FIG. 1E.

During the extraction travel of the mobile frame (22), i.e. until the length of the table has lower values (L3) than the maximum values (L2), the wheels (82) slide against the side members (11) of the fixed frame (10) under pressure because of the thrust exerted by said arms (80) that in turn are subject to the thrust of said spring (90) by means of the compass levers (70), as shown in FIGS. 2A and 2E.

One end of said spring (90) is fastened to said pin (71), and the other end is fastened to a hook (25*b*) fixed to said third crosspiece (25), when said wheels (82) penetrate the side members (11), said pin (71) is attracted towards said third crosspiece (25), with consequent travel of the longitudinal rod (60) relative to the pair of crosspieces (24 and 25) and of said peg (55) relative to the shaped slot (54).

In view of the preceding description, with reference to all the structural components of the extension table (100) according to the invention, now the explanation of its operating mode will be easily understood.

When the extension table (100) is in contracted position with minimum volume:

the extension top (40) lies under the main top (30) with the side (40*a*) with width (L40) oriented in parallel direction to the longitudinal axis (Y) of the table (100), as shown in FIG. 3;

the pin (55) is not coupled with the shaped slot (54);

the arms (80) press the wheels (82) against the longitudinal side members (11) of the fixed frame (10), as shown in FIG. 2E.

When the mobile frame (20) is pulled out from the fixed frame (10) said pull-out operation may not be accidentally completed, stopping the travel of the mobile travel (20) before the end of its extraction travel, as shown in FIGS. 2 and 4.

In such a case, it would be possible to make the extension-holding trolley (41) slide until the end-of-travel position, away from the fixed frame (10), in such a way to pull out and raise the extension top (40) from under the main top (30), but it is no longer possible to proceed with the rotation of 90° of the extension plane (40).

Said obstacle is represented by the pin (55) that after being inserted in the first rectilinear section (54*a*) of the shaped slot (54), is stopped in an intermediate point without making the entire travel, being disposed in a position that prevents the rotation of the revolving disk (50) and of the extension top (40) constrained in the revolving disk (50), as shown in FIG. 2D.

In order to eliminate said obstacle, the mobile frame (20) must be moved to the end of the extraction travel, as shown in FIGS. 1-8, in such a way to allow for diverging the compass levers (70) with consequent forward movement of the longitudinal rod (60) and of the pin (55), which is moved in correspondence of the opening of the second curvilinear section (54*b*) of the slot (54), as shown in FIG. 1D.

Figure 9:
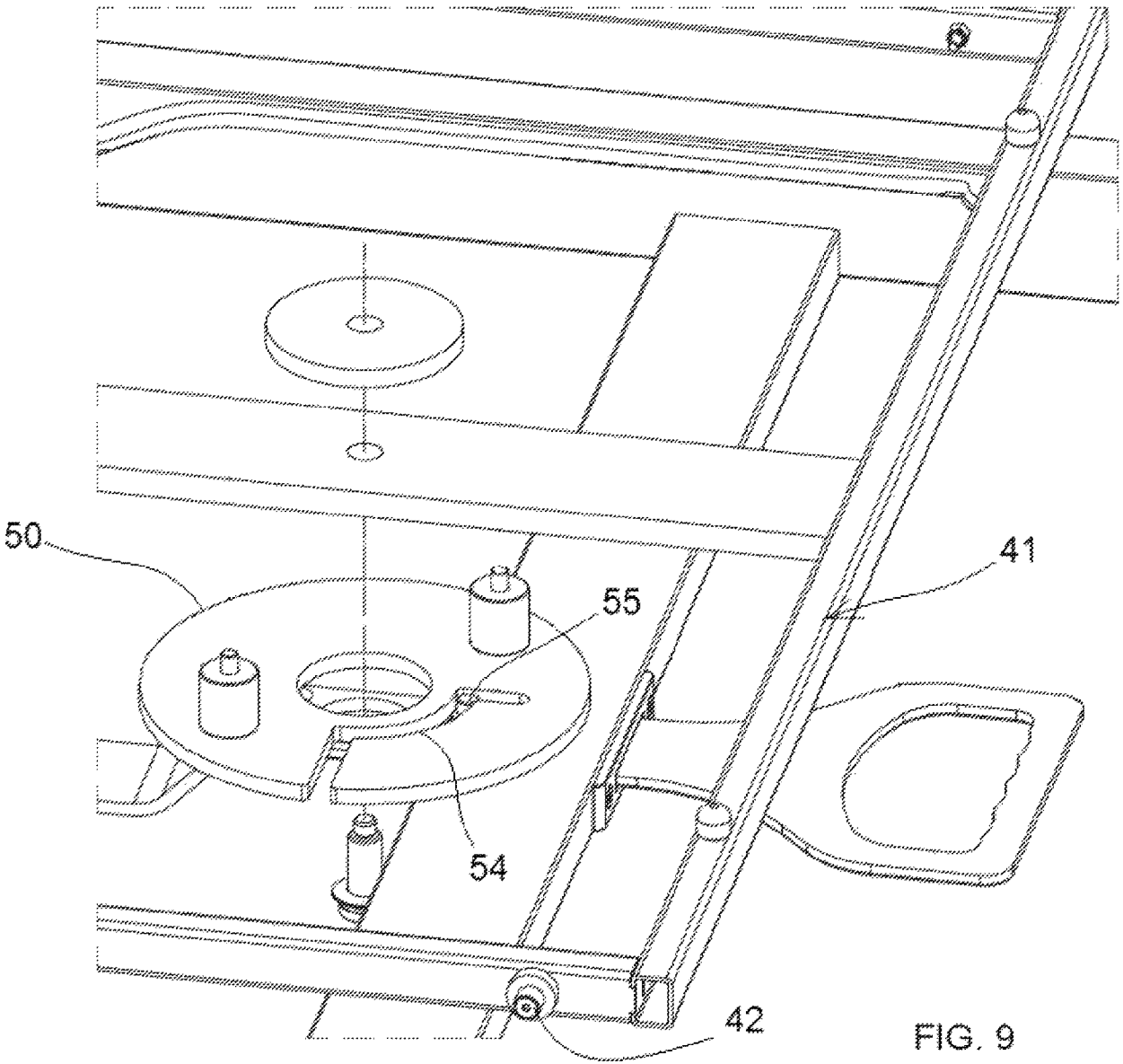
FIG. 9 is the same as FIG. 1D, except for it shows the same parts in the position taken after rotating the extension top by 90°, as shown in FIG. 8.

In such a condition, the extension top (40) can be rotated by 90°, driving the revolving disk (50) into rotation, because the movement is no longer hindered by the pin (55) that slides along the second curvilinear section (54*b*) of the slot (54) until it is disposed in correspondence of the opening of the third rectilinear section (54*c*) of the slot (54), as shown in FIG. 9.

After rotating the extension top (40) by 90°, the mobile frame (20) is pushed towards the fixed frame (10) for a short approaching travel in such a way to bring the side (40*a*) of the extension table (40) against the transverse side (30*a*) of the main top (30).

Evidently, before starting such a short approaching travel, the user must grab and pull the handle (61) towards him/her in such a way to cause a backward movement of the wheels (82), which are extracted from the seats (11*a*) of the side members (11), loading the spring (90).

Figure 10:
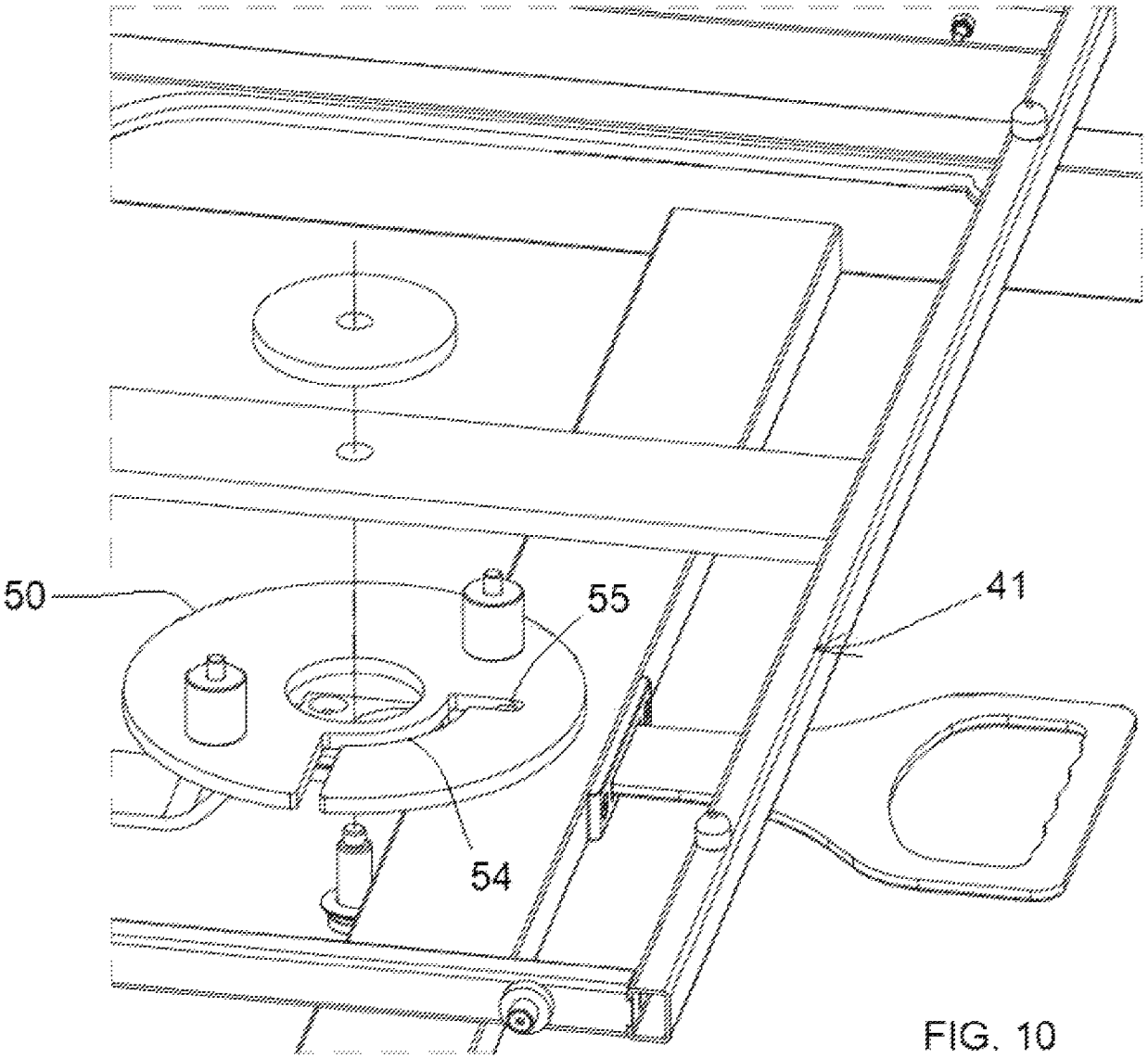
FIG. 10 is the same as FIG. 9, except for it shows the same parts in the position taken after rotating the extension top by 90°, as shown in FIG. 1D, and after successively bringing the extension top in contact with the main top.

After such an approaching travel of the extension top (40) towards the main top (30), the peg (55) travels along a section of the third rectilinear section (54*c*) of the shaped slot (54). After loading the spring (90), the pin (55) will be disposed in an intermediate point of the third rectilinear section (54*c*) of the slot (54), as shown in FIG. 10.

I claim:

1. An extension table with an axis of longitudinal symmetry (Y), the extension table comprising:

a) a fixed frame having a pair of legs and a horizontal rectangular structure that supports a main top and is formed of a parallel pair of longitudinal side members connected by a crosspiece;

b) a mobile frame having a pair of legs and a horizontal rectangular structure formed of a parallel pair of longitudinal side members connected by a first crosspiece, said mobile frame being telescopically coupled with said fixed frame so that the extension table has a pair of end-of-travel positions, the pair of end-of-travel positions being a contracted position that corresponds to a minimum length (L1) and an extended position that corresponds to a maximum length (L2), and a set of intermediate positions between the pair of end-of-travel positions that correspond to intermediate length values (L3) between a value the minimum length (L1) and a value of the maximum length (L2);

c) an extension top supported by an extension-holding trolley revolvable around a vertical axis (Z) that intersects the axis of longitudinal symmetry (Y), the extension-holding trolley being slidingly supported by the pair of side members that are coupled with the extension-holding trolley by a cam-tappet that imposes up-down travels during forward and backward translations of the extension holding trolley relative to the pair of side members in such a way that the extension-holding trolley and said extension top are disposed at two different parking heights relative to the pair of side members of said mobile frame, the two different parking heights comprising:

a lower parking height, wherein an upper surface of said extension top lies under a lower surface of the main top; and a higher parking height, wherein the upper surface of said extension top is coplanar with an upper surface of the main top, said higher parking height being reached only after pushing the extension-holding trolley to the end-of-travel position away from said fixed frame;

d) a revolving disk fixed under said extension top and having a shaped slot;

e) a vertical pin that protrudes from a longitudinal rod slidingly supported by said mobile frame and being coupleable with the shaped slot only when the extension-holding trolley slides and reaches said higher parking height, wherein said vertical pin is slidable along a direction that coincides with the axis of longitudinal symmetry (Y) between the pair of end-of-travel positions, wherein said vertical pin hinders a rotation of said revolving disk, if said vertical pin is coupled with the shaped slot, and, said vertical pin allows the rotation of said revolving disk when said vertical pin is not coupled with the shaped slot, wherein said vertical pin is always disposed in its first end-of-travel position so as to hinder the rotation of the revolving disk when a length of the extension table is one of the intermediate length values (L3), wherein said vertical pin automatically moves to the extended position so as to allow the rotation of the revolving disk only when the length of the extension table is the maximum value (L2); and f) an automatic means for moving said vertical pin mounted on said mobile frame and to move said vertical pin to the extended position so as to allow the rotation of the revolving disk only when the length of the extension table is the maximum length (L2).

2. The extension table of claim 1, wherein said shaped slot comprises:

a first rectilinear section that is directed in radial direction towards a center from a perimeter edge of said revolving disk without reaching the center of the perimeter edge, said first rectilinear section being perfectly aligned with the axis of longitudinal symmetry (Y) of the extension table until said extension top is rotated after the extension-holding trolley slides to said higher parking height;

a second curvilinear section joined with said first rectilinear section, that extends for an arch equal to one-fourth of a circumference thereof; and a third rectilinear section joined with said second curvilinear section and directed in a radial direction towards the perimeter edge of said revolving disk without reaching the perimeter.

3. The extension table of claim 2, wherein the longitudinal rod is disposed under said revolving disk and is constantly subject to a longitudinal thrust exerted by a return spring that moves the longitudinal rod in a longitudinal travel only when the length of the extension table is the maximum length (L2), wherein the longitudinal travel of the longitudinal rod corresponds to an equivalent travel of said vertical pin that automatically moves to the extended position so as to allow the rotation of said revolving disk, wherein said vertical pin is disposed at an end of said first rectilinear section of the shaped slot and in an opening of said second curvilinear section of the shaped slot.

4. The extension table of claim 3, wherein said parallel pair of longitudinal side members are connected by a second crosspiece and a third crosspiece respectively disposed in proximal and distal positions relative to said first crosspiece, said second and third crosspieces having slots that receive and slidingly support the longitudinal rod.

5. The extension table of claim 4, wherein said automatic means for moving said vertical pin comprises:

the longitudinal rod that slides relative to said mobile frame;

a pair of compass levers and a pin disposed at a vertex of the compass lever, said pin being fixed to the longitudinal rod, whereas the pins disposed at feet of compass legs of the pair of compass levers are fixed to two sliding arms that are perpendicular to an axis of longitudinal symmetry of the extension table and inserted through the third crosspiece having a tubular structure so as to house and guide the two sliding arms that cross the third crosspiece and protrude from the third crosspiece with an ending section, wherein a wheel is mounted so as to revolve around a vertical axis;

a through slot corresponding to each of the pair of longitudinal side members of said mobile frame and dimensioned to house the ending section and the wheel; and a niche formed in each of the pair of longitudinal side members of said fixed frame and receiving the wheel only when the length of the extension table is the maximum length (L2), said return spring having a first end fixed to the pin and a second end fixed to a hook connected to the third crosspiece.

6. The extension table of claim 5, wherein the longitudinal rod has a first end with a handle near the third crosspiece of said mobile frame and a second end supporting said pair of compass levers.

7. The extension table of claim 1, wherein said revolving disk is fixed to said extension top by a. diametrically opposite pair of screws that are inserted from below through said revolving disk and through a pair of bushings.

8. The extension table of claim 7, wherein the extension-holding trolley comprises a rectangular frame formed of a pair of longitudinal sides joined at a right angle by a pair of crosspieces, the extension-holding trolley further comprising a flat strip that extends between two central points of a pair of transverse sides and operates as a stop for the pair of bushings at an end of the rotation of said revolving disk.

9. The extensible table of claim 8, wherein said extension top is fixed to the extension-holding trolley by a vertical screw that is inserted from below through a hole in a center of said revolving disk and through a hole on the flat strip so as to be screwed in a central position under said extension top.

10. The extension table of claim 4, wherein the second crosspiece comprises a longitudinal notch that houses and guides the pin.

* * * * *